US006612784B2

(12) United States Patent
Rainey et al.

(10) Patent No.: US 6,612,784 B2
(45) **Date of Patent: *Sep. 2, 2003**

(54) MODULAR RETAINING WALL SYSTEM

(75) Inventors: Thomas L. Rainey, Acworth, GA (US); Svenn Borgersen, Eagan, MN (US); John W. Turgeon-Schramm, Brooklyn Park, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/035,616

(22) Filed: Dec. 28, 2001

(65) Prior Publication Data

US 2002/0094241 A1 Jul. 18, 2002

Related U.S. Application Data

(63) Continuation of application No. 09/049,627, filed on Mar. 27, 1998, now Pat. No. 6,338,597.

(51) Int. Cl.[7] ..... E02D 29/02

(52) U.S. Cl. ..... 405/284; 405/262; 405/286; 52/604

(58) Field of Search ..... 405/262, 284, 405/286; 52/603–605, 607, 283, 284, 286, 590.1, 590.2, 592.6; 403/76, 348, 359.6

(56) References Cited

U.S. PATENT DOCUMENTS

| | | | | | |
|---|---|---|---|---|---|
| 1,130,324 | A | | 3/1915 | Owen | 446/127 |
| 5,282,700 | A | * | 2/1994 | Rodrique | 405/284 |
| D350,611 | S | * | 9/1994 | Scales | D25/114 |
| 5,417,523 | A | * | 5/1995 | Scales | 405/262 |
| 5,511,910 | A | * | 4/1996 | Scales | 405/262 |
| 5,595,460 | A | * | 1/1997 | Miller et al. | 405/284 |
| 5,607,262 | A | * | 3/1997 | Martin | 405/262 |
| 6,006,486 | A | * | 12/1999 | Moriau et al. | 52/589.1 |
| D435,304 | S | * | 12/2000 | Rainey | D25/114 |
| 6,318,934 | B1 | * | 11/2001 | Borgersen et al. | 405/262 |
| 6,338,597 | B1 | * | 1/2002 | Rainey | 405/262 |
| 6,416,257 | B1 | * | 7/2002 | Rainey | 405/262 |

OTHER PUBLICATIONS

US 6,089,793, 7/2000, Rainey (withdrawn)
"Anchor Landmark™ System" brochure, published Mar. 2000.

* cited by examiner

*Primary Examiner*—Thomas B. Will
*Assistant Examiner*—Tara L. Mayo
(74) *Attorney, Agent, or Firm*—Thomas, Kayden, Horstemeyer & Risley, LLP

(57) ABSTRACT

A modular earth retaining wall system comprising a plurality of similarly configured wall blocks that have lock channels and lock flanges that provide a locking mechanism for resisting leaning or toppling of the blocks. A positive retaining mechanism is also provided for attaching reinforcement fabrics to the retaining wall in between mating courses of wall blocks. This mechanism secures the reinforcement fabrics in place and permits the fabrics to extend along the entire contact area between adjacent stacked wall blocks to avoid an aggregate leaning effect. The retaining mechanism includes a retaining bar that is placed on top of the reinforcement fabric within the lock channel. The retaining bar holds the fabric against a wall of the lock channel in response to tensile loads applied to the fabric to prevent it from being pulled out of the retaining wall.

7 Claims, 6 Drawing Sheets

MODULAR RETAINING WALL SYSTEM

CROSS-REFERENCE TO RELATED APPLICATION

This is a continuation of U.S. patent application Ser. No. 09/049,627, filed Mar. 27, 1998, now U.S. Pat. No. 6,338,597 which is hereby incorporated by reference in its entirety into the present disclosure.

FIELD OF THE INVENTION

The invention relates generally to earth retaining walls. More particularly, the invention relates to a modular retaining wall system composed of a plurality of wall blocks that are provided with locking means for precluding forward leaning or tipping of the blocks. Further, the invention pertains to retaining means for attaching reinforcement members to the retaining wall in between mating courses of wall blocks formed in the retaining wall.

BACKGROUND OF THE INVENTION

Modular earth retaining walls are commonly used for architectural and site development applications. Such walls are subjected to very high pressures exerted by lateral movements of the soil, temperature and shrinkage effects, and seismic loads. Therefore, the backfill soil typically must be braced with tensile reinforcement members. Usually, elongated structures, commonly referred to as geogrids or reinforcement fabrics, are used to provide this reinforcement. Geogrids are often configured in a lattice arrangement and are constructed of a metal or polymer while, reinforcement fabrics are constructed of a woven or nonwoven polymer fiber. These reinforcement members typically extend rearwardly from the wall and into the soil to stabilize the soil against movement and thereby create a more stable soil mass which results in a more structurally secure retaining wall.

Although several different forms of reinforcement members have been developed, difficulties remain with respect to attachment of the members to retaining walls. In particular, the reinforcement members can shift out of position and be pulled out from the retaining wall due to movement of the soil. This difficulty can be especially problematic in areas of high seismic activity. In response to this problem, several current retaining wall systems have been developed to retain geogrid reinforcement members. Rake shaped connector bars are transversely positioned in the center of the contact area between adjacent stacked blocks with the prongs of the connector bar extending through elongated apertures provided in the geogrid to retain it in place. Despite adequately holding the geogrid in position under normal conditions, this system of attachment provides a substantial drawback. Specifically, the geogrids of the system only extend along the back halves of the contact areas between the blocks. Although the geogrids are relatively thin, this partial insertion of the geogrids can cause the retaining wall to bow outwardly due to the aggregate thickness of the geogrids. As can be appreciated, this outward bowing can be substantial with tall retaining walls that require a multiplicity of geogrids. Aside from creating the impression of instability, this condition increases the likelihood of wall failure, particularly in response to seismic activity.

Another problem associated with the construction of modular retaining walls is securement of the blocks to each other within the wall. Various connection methods are currently used in retaining wall construction to interlock the blocks. In one known system, blocks having bores inwardly extending within their top and bottom surfaces are provided for the receipt of dowels or pins. In addition to limiting shifting of the blocks, these pins are used to retain geogrids. Where a geogrid is to be inserted between two courses of stacked blocks, the pins are inserted into the bores with the pins extending through the apertures of the geogrid. Although providing some resistance against block shifting, the actual strength of the block-to-block connection is generated by the friction between the block surfaces. Therefore, shifting can occur. Moreover, the pins do not lock the upper blocks to the lower blocks. Accordingly, severe seismic activity can cause the upper blocks to jump from their foundations and topple downward. Additionally, when the pins are made of metal, they will corrode over time due to the infiltration of moisture from the surrounding environment.

In another known retaining wall, an upper surface of the blocks includes a projection and a lower surface of the blocks includes a cavity into which the projection can extend. Although the provision of these projections and cavities avoids the corrosion problem associated with the pins of the previously described system, similar to that system, no positive locking mechanism is provided to retain the upper blocks on top of the lower blocks. Therefore, this system is susceptible to toppling in response to strong seismic activity. In addition, construction of the walls is complicated by the fact that the top course of blocks must be held in place when the backfill soil is poured to prevent the blocks from being pushed over the edge of the wall.

It can therefore be appreciated that there exists a need for a mechanically stabilized wall system having secure retaining means for maintaining reinforcement members in their proper positions within the wall. Accordingly, it is to the provision of such an improved mechanically stabilized retaining wall system that the present invention is directed.

SUMMARY OF THE INVENTION

The present invention provides a mechanically stabilized wall system having secure retaining means for maintaining reinforcement members in their proper positions within the retaining wall. Retaining walls constructed in accordance with the invention comprise a plurality of wall blocks that are stacked on top of each other in a plurality of ascending courses. Generally, each of the wall blocks is substantially identical in size and shape to simplify block fabrication and wall construction. Therefore, each of the blocks comprises an exterior face, an interior face, a top surface, a bottom surface, and opposed sides. The exterior faces of the blocks form the exterior surface of the retaining wall and typically are provided with an ornamental facing. In addition, the exterior face of each block normally slopes inwardly from the bottom surface to the top surface of each block.

The top and bottom surfaces of the blocks are typically parallel to each other such that the blocks can be stacked atop each other to form an upright wall. Similarly, the opposed sides of the blocks are normally parallel to each other such that a straight wall will be formed. The top and bottom surfaces of each block are provided with a lock channel and lock flange, respectively. The lock channel is defined by a front wall, a rear wall, and a channel bottom surface and the channel typically extends transversely across the top surface of each wall block. The front wall of this channel forms a frontal lip that extends obliquely toward the exterior face of the wall block. The frontal lip is normally curved such that a first substantially arcuate edge of the channel is formed. Positioned opposite the front wall, the rear wall of the lock channel extends obliquely toward the interior face of the wall block. Like the front wall, an upper extent of the rear wall is typically curved so as to form a second substantially arcuate edge of the lock channel. Provided in the channel bottom surface is a longitudinal notch that usually extends the full length of the lock channel.

The lock flange is defined by a front surface, a rear surface, and a top surface and typically extends transversely across the bottom surface of the wall block. Each of the front and rear surfaces extend obliquely toward the exterior face of the wall block such that the lock flange itself extends obliquely towards the exterior face. The front surface of the flange is specifically sized and shaped for mating engagement with the front wall and frontal lip of the lock channel.

Positioned between at least one pair of mating courses of wall blocks is a reinforcement member. This reinforcement member is of known construction and typically extends from the exterior surface of the retaining wall, into the lock channel, and past the interior surface of the retaining wall to extend into the soil. Placed on top of the reinforcement member in the lock channel is a retaining bar which secures the reinforcement member in place between the courses of the wall. The retaining bar is sized and shaped for easy insertion into the lock channel. In a preferred arrangement, the retaining bar has a top surface, a bottom surface, a first upright surface, a second upright surface, a first oblique surface, and a second oblique surface. Normally, the top and bottom surfaces are parallel to each other as are the first and second oblique surfaces. Configured in this manner, the retaining bar fits closely between the front and rear walls of the channel so that the first upright surface and the second oblique surface of the retaining bar hold the reinforcement member against the front and rear walls of the channel, respectively. So disposed, the retaining bar prevents the reinforcement member from being removed from the retaining wall.

In constructing a retaining wall according to the present invention, a plurality of starting blocks are usually aligned along the length of a leveling pad formed on the construction site. Each of the starting blocks is provided with a lock channel in its top surface just as the above described wall blocks. However, since the starting blocks form the first course of the wall, they need not be provided with lock flanges.

After the starting course has been formed, the first course of wall blocks is constructed. Each of the wall blocks is placed on top of one or more starting blocks with the lock flanges of each wall block extending into the lock channels of the lower blocks. The upper blocks are then slid forward along the starter blocks until the lock flanges of the upper blocks engage the front walls of the lock channels provided in the starter blocks. Specifically, the front surface of the lock flanges and frontal lip of the lock channels mate such that the lock flanges extend underneath the frontal lips. This mating relationship holds the wall blocks in place atop the starter blocks and prevents them from tipping forward, thereby providing an integral locking means for the blocks. After the first course of wall blocks has been formed, the backfill soil can be poured into place behind the blocks. In that the blocks are locked into place with the mating relationship of the frontal lips and lock flanges, the pouring of the soil can be accomplished without having to provide additional stabilization to the blocks to prevent them from toppling forward.

Once the proper amount of soil has been poured, additional courses are laid in the manner described above. Typically, a reinforcement member is laid between every other course of blocks, although it will be appreciated that greater or fewer reinforcement members can be provided depending upon the particular reinforcement needs of the construction site. As noted above, the reinforcement member is positioned so that it extends from the exterior surface of the wall and into the lock channel before extending into the backfill soil. To lock the reinforcement member between the courses, a retaining bar is placed on top of the reinforcement member in the lock channel. When the next course of blocks is laid, the lock flange of the upper blocks extend into the lock channels so that they are positioned adjacent the retaining bar. When a tensile force is applied to the reinforcement member from the soil side of the retaining wall, the retaining bar is urged towards the interior surface of the retaining wall, causing the second oblique surface to press the reinforcement member against the rear wall of the channel, locking it in place.

The objects, features, and advantages of this invention will become apparent upon reading the following specification, when taken in conjunction with the accompanying drawings.

DETAILED DESCRIPTION

Figure 1:
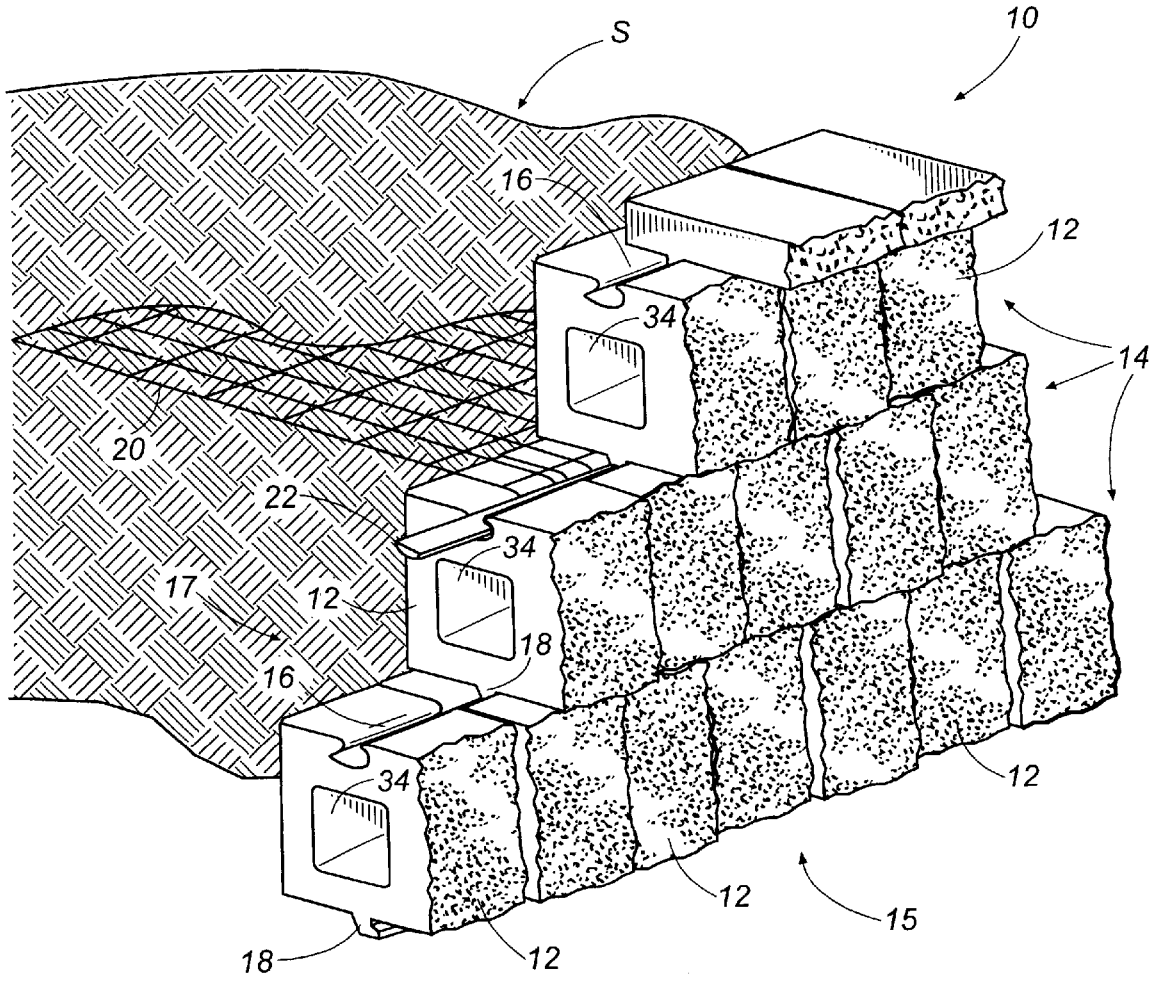
FIG. 1 is a perspective view of a retaining wall formed in accordance with the present invention.

Referring now in more detail to the drawings, in which like numerals indicate like parts throughout the several views, FIG. 1 illustrates the general concept of a modular retaining wall 10 constructed in accordance with the present invention. As depicted in this figure, the retaining wall comprises a plurality of wall blocks 12 that are stacked atop each other in ascending courses 14. When stacked in this manner, the wall blocks together form an exterior surface 15 which faces outwardly away from the soil, and an interior surface 17 which faces inwardly toward the soil.

Generally speaking, the blocks 12 are substantially identical in size and shape for ease of block fabrication and wall construction. Accordingly, each block is provided with a lock channel 16 and a lock flange 18 that are configured so as to mate with each other when the blocks are stacked atop one another to form the retaining wall 10. When the blocks are aligned side-by-side within each course as shown in FIG. 1, the lock channels 16 form a continuous lock channel that extends the length of the lower of the mating courses. Similarly, the lock flanges form a continuous lock flange that extends the length of the upper of the mating courses. Accordingly, the blocks can be stacked in a staggered arrangement as shown in FIG. 1 to provide greater stability to the wall. In addition to providing for correct alignment of the blocks of each course, the lock channels and lock flanges preclude forward leaning or toppling of the blocks. Therefore, the lock channels and lock flanges serve as integral locking means for positively locking the blocks together.

Positioned between two mating courses of wall blocks is a reinforcement member 20. The reinforcement member is of known construction and typically extends from the exterior surface 15 of the retaining wall 10 and into the backfill soil S. Specifically, the reinforcement member extends from the exterior surface 15, into the lock channel 16, and past the interior surface 17 of the retaining wall to extend into the soil. Placed on top of the reinforcement member in the lock channel 16 is a retaining bar 22. This retaining bar secures the reinforcement member in place between the courses of the retaining wall and therefore forms part of retaining means for securing the reinforcement member in place with respect to the retaining wall. In that a continuous lock channel is formed by the blocks, a single elongated retaining bar can be used. However, it will be understood that several shorter retaining bars could be used if desired.

Figure 2:
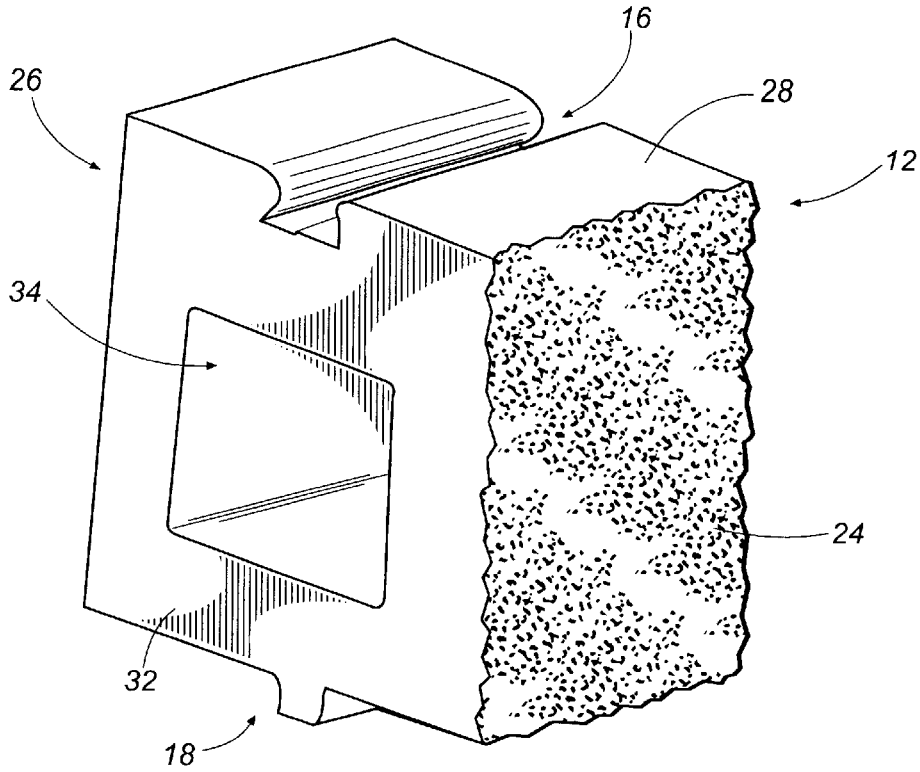
FIG. 2 is a perspective front view of a wall block used in the present system.
Figure 3:
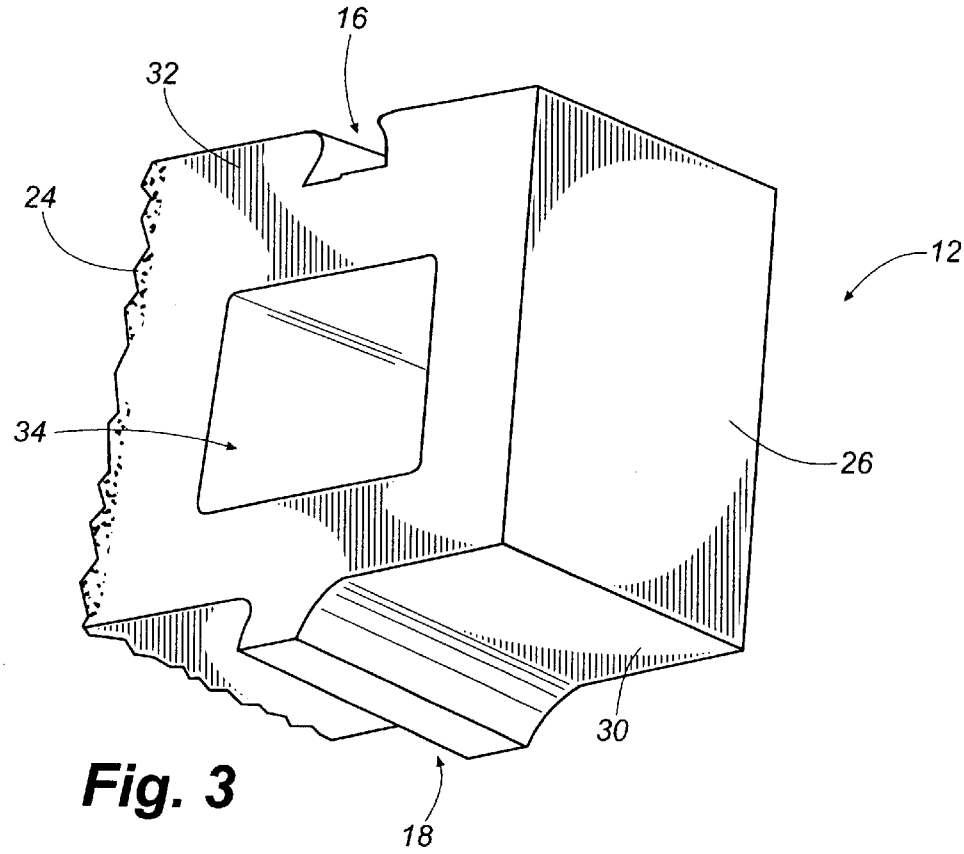
FIG. 3 is a perspective rear view of the wall block shown in FIG. 2.

Having generally described type of retaining wall that can be constructed in accordance with the present disclosure, a detailed description of the wall blocks will now be provided. Referring to FIGS. 2 and 3, each wall block 12 comprises an exterior face 24, an opposed interior face 26, a top surface 28, a bottom surface 30, and two opposed sides 32. As briefly identified above, the exterior faces of the blocks form the exterior surface of the retaining wall. Accordingly, the exterior faces are typically provided with an ornamental facing to create a visually pleasing facade. Also, the exterior face 24 of each wall block usually is sloped inwardly from the bottom surface 30 to the top surface 28 in an incline ratio of approximately 30 to 1. This inward slope creates an aggregate inward slope effect over the entire retaining wall which counteracts the outward leaning impression commonly created by such walls when viewed by the observer. Contrary to the exterior face, the interior faces 26 of the wall blocks are configured in an upright orientation and, therefore, form the upright interior surface of the retaining wall. Normally, the blocks are approximately 15 inches tall and 8 inches wide, although it will be appreciated that almost any size block can be formed in accordance with this disclosure.

The top and bottom surfaces 28 and 30 of each block are typically parallel to each other so that, when stacked on top of one another, an upright wall is formed. Similar to the interior faces 26, the opposed sides 32 are typically parallel to each other. However, the opposed sides can be inwardly tapered from the exterior face of the block to the interior face of the block to form curved walls of nearly any shape. Further provided in the wall blocks are interior openings 34. These openings reduce the amount of materials needed to fabricate the blocks and reduces the weight of the blocks to simplify wall construction.

Figure 4:
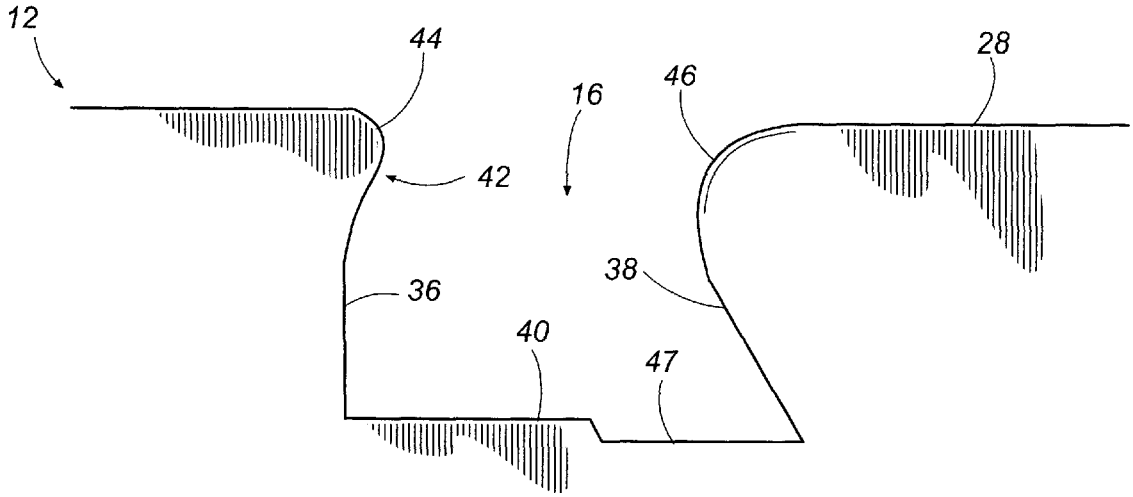
FIG. 4 is a detail view of a lock channel provided in a top surface of the wall blocks.

As described above, the top and bottom surfaces of each block are provided with a lock channel 16 and lock flange 18, respectively. Illustrated in FIG. 4, the lock channel 16 is defined by a front wall 36, a rear wall 38, and a channel bottom surface 40 and extends transversely across the top surface 28 of each wall block. The front wall forms a frontal lip 42 that extends obliquely toward the interior face 26 of the wall block 12. As indicated in the figure, the oblique extension of the frontal lip begins at a point approximately halfway along the height of the front wall 36. The lip is normally curved such that a first substantially arcuate edge 44 of the channel is formed. Positioned opposite the front wall, the rear wall 38 of the lock channel 16 extends obliquely toward the exterior face 24 of the wall block 12. Like the front wall, an upper extent of the rear wall is curved so as to form a second substantially arcuate edge 46 of the lock channel. Provided the channel bottom surface 40 is a longitudinal notch 47. This notch typically extends the full length of the lock channel and, as will be described below, facilitates insertion of a reinforcement member retaining bar.

Figure 5:
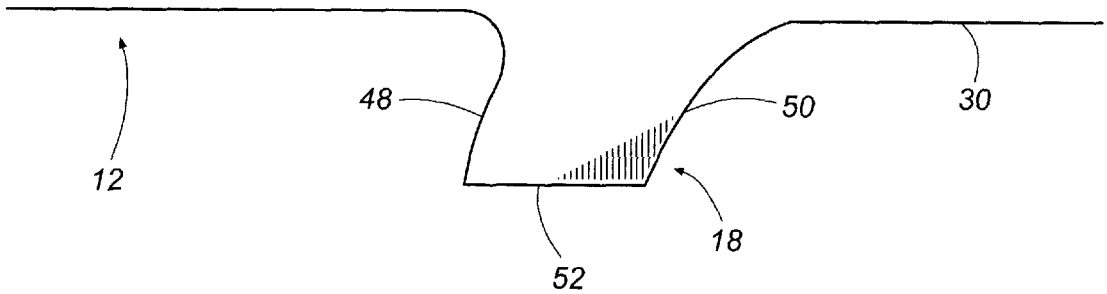
FIG. 5 is a detail view of a lock flange provided on a bottom surface of the wall blocks.

Illustrated in FIG. 5 is the lock flange 18. As indicated in this figure, the lock flange is defined by a front surface 48, a rear surface 50, and a top surface 52 and the flange extends transversely across the bottom surface 30 of the wall block. Similar to the rear wall 38 of the lock channel, both the front surface 48 and the rear surface 50 extend obliquely toward the exterior face 24 of the wall block 12 such that the lock flange 18 itself extends obliquely towards the exterior face 24 of the block. To provide for the locking function noted above, the front surface 48 of the block is specifically sized and shaped for mating engagement to the front wall 36 of the lock channel 16. Accordingly, during wall construction, the wall blocks can be placed on top of lower wall blocks such that the lock flanges extend into the lock channels. Once so situated, the upper wall blocks can be slid forward along the lower blocks so that the front surfaces 48 of the lock flanges 18 abut the front walls 36 of the lock channels. As will be described below, it is this abutment that prevents the block from leaning forward or toppling.

Although capable of alternative construction, the wall blocks 12 are preferably formed of pre-cast concrete. As is known in the art, the blocks are commonly mixed in a hatching plant in a high-speed process. Cement, aggregate, and water are mixed in a hopper to form a concrete mixture which is poured into a mold box to form the blocks. To increase block output of this process and simplify the block forming process, typically a multiple block mold is used. In particular, the mold is configured to form one continuous piece from which several blocks will be made. Once the piece is formed, the individual blocks are separated from the extended piece with a splitter that slices through the piece. In this manner, the number of mold fillings and compactions per block is reduced, increasing fabrication productivity. This splitter also typically gives the exterior face of the block a rough split-stone appearance.

Figure 6:
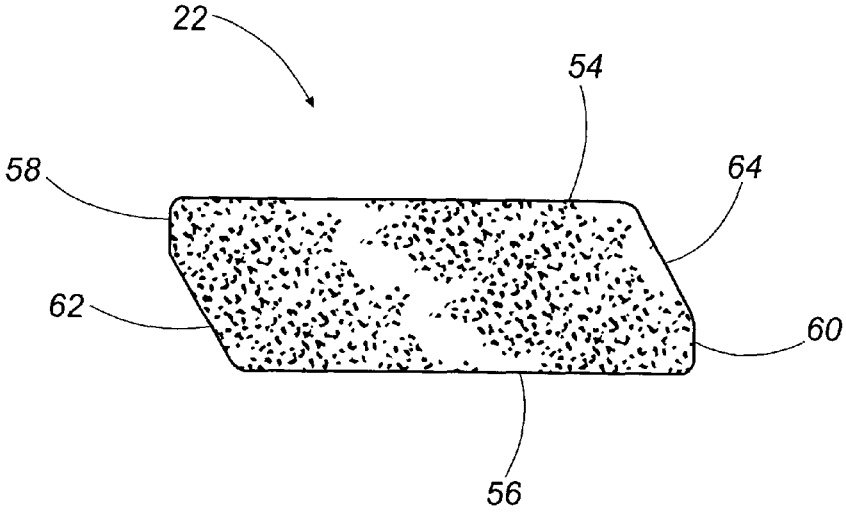
FIG. 6 is a side view of a reinforcement member retaining bar used in the present system.

The reinforcement member retaining bar 22, shown most clearly in FIG. 6, is specifically shaped and configured to fit within the lock channel 16. In a preferred arrangement, the retaining bar 22 has six different surfaces: a top surface 54, a bottom surface 56, a first upright surface 58, a second upright surface 60, a first oblique surface 62, and a second oblique surface 64. Normally, the top surface and the bottom surface are parallel to each other as are the first oblique surface and the second oblique surface. Similarly, the first upright surface and the second upright surface are typically parallel to each other such that the first upright surface extends perpendicularly from the upper surface and the second upright surface extends perpendicularly from the bottom surface. Configured in this manner, the retaining bar can be positioned on top of a reinforcement member 20 in the lock channels 16 by inserting the retaining bar into the channels with the second upright surface 60 forward, and twisting the bar downward into place as depicted in FIG. 7.

In that the bar is designed to fit closely between the front and rear walls of the channels when in place, the longitudinal notch 46 provides a void that accommodates the second upright surface to facilitate the twisting and downward insertion of the bar.

Figure 7:
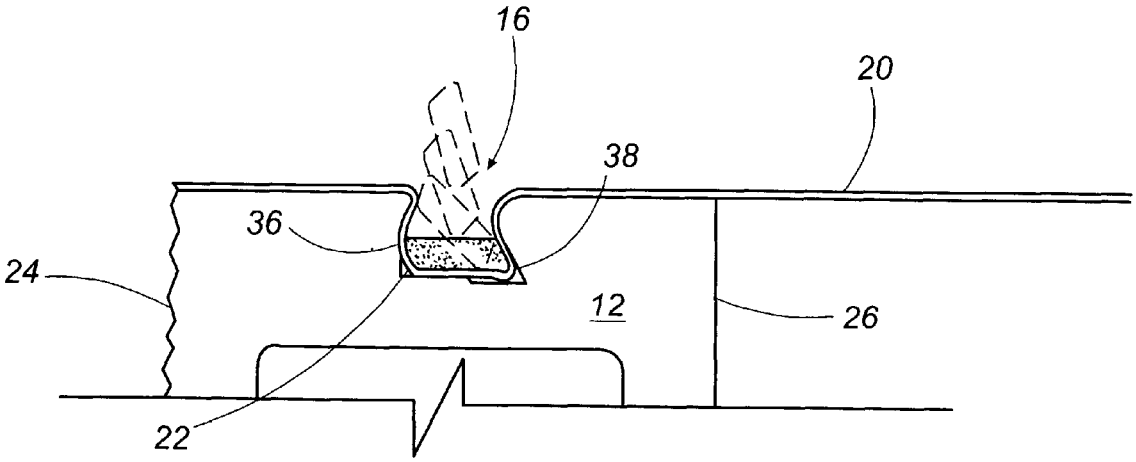
FIG. 7 is a partial side view of a wall block depicting insertion of a retaining bar over a reinforcement member within a lock channel of the wall block.

Once correctly inserted within the lock channel, the first upright surface 58 and the second oblique surface 64 of the retaining bar hold the reinforcement member 20 against the front and rear walls of the channel, respectively, as shown in FIG. 7. So disposed, the retaining bar prevents the reinforcement member from being pulled out from the retaining wall. Specifically, when a tensile force is applied to the reinforcement member from the soil side of the retaining wall, the retaining bar is urged towards the interior surface of the retaining wall, causing the second oblique surface 64 to press the reinforcement member against the rear wall 38 of the channel, locking it in place. In that the amount of pressure that must be applied by the retaining bar is not large, the retaining bar can be constructed of a polymeric material such as nylon 66 or high density polyethylene. Usage of such polymers provides the additional advantages of being lightweight and therefore easy to manipulate, and chemically inert and therefore resistant to corrosion.

Several different types of reinforcement members are currently available. For example, both metal and polymeric geogrids are in manufacture. In the present system, however, the selected reinforcement member must be adequately flexible to permit insertion of the reinforcement member into the lock channel and subsequent insertion of the retaining bar. Furthermore, the selected reinforcement member, like the retaining bar, should be constructed of an inert material which will resist rusting or other corrosion. Accordingly, it is preferred that the reinforcement member comprise a flexible fabric composed of a polymeric material such as polypropylene or high tenacity polyester.

Figure 8:
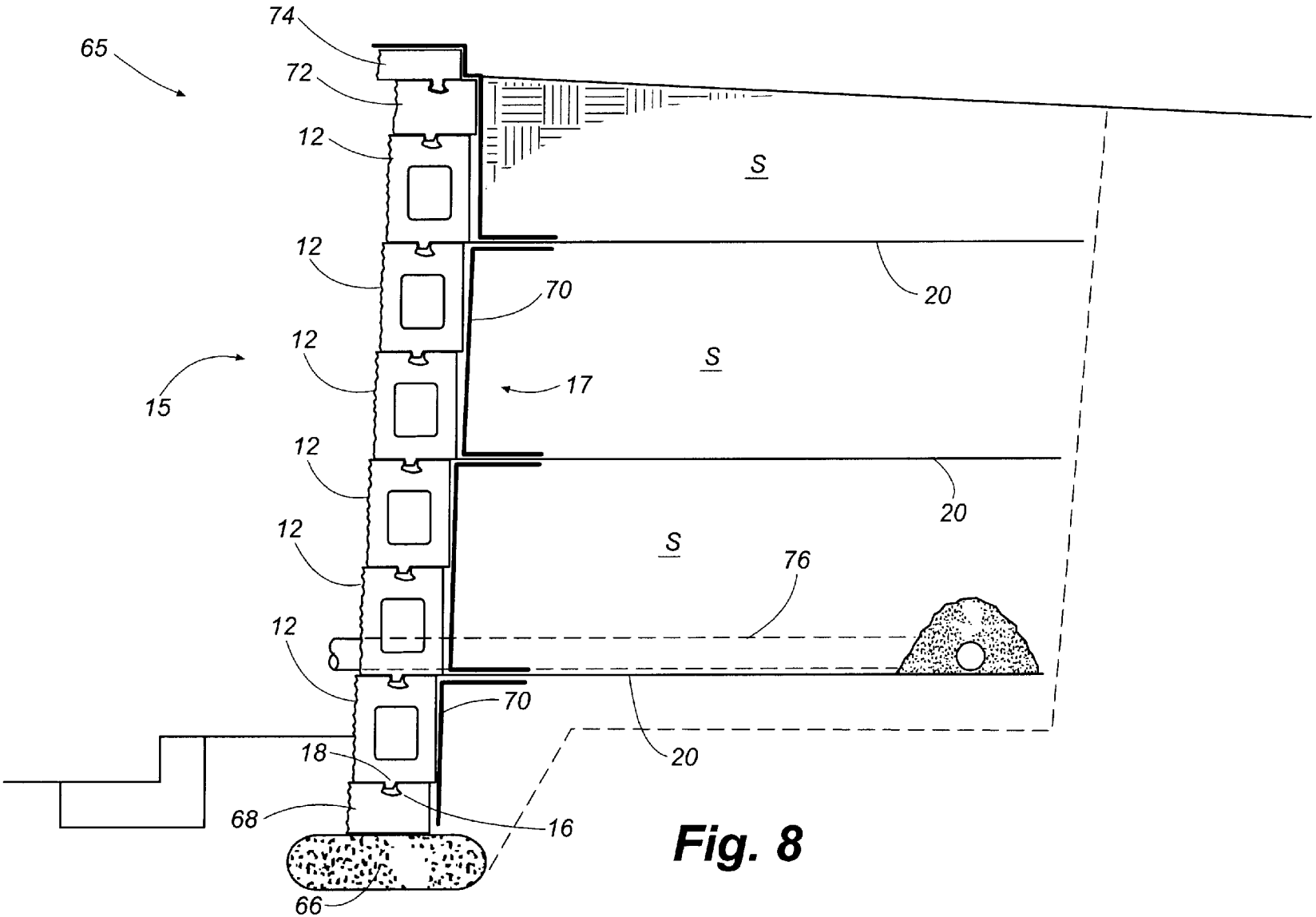
FIG. 8 is a cross-sectional view of an example retaining wall constructed in accordance with the present invention.

The system of the present invention can be used to construct any number of different configurations of modular retaining walls. FIG. 8 illustrates one example of such a retaining wall 64. To construct such a wall, a leveling pad 66 is laid to provide a foundation upon which to build the wall. Typically, this leveling pad comprises a layer of compacted crushed stone that is embedded under the soil to protect the wall foundation. Once the leveling pad is laid and compacted, a plurality of starting blocks 68 are aligned along the length of the pad. Each of the starting blocks is provided with a locking channel in its top surface. However, since there are no lower courses with which to engage, the starter blocks are not provided with lock flanges. Additionally, the starting blocks are only approximately half as tall as the wall blocks and are therefore approximately 7.5 inches in height. Although such starting blocks are typically used in the starting course of the retaining wall, it is to be noted that the standard wall blocks 12 could be used to form this course if a groove is provided in the leveling pad to accommodate the lock flanges of the blocks. As is evident from FIG. 8, the starting course of the wall is normally embedded underground along with the leveling pad.

After the starting course has been formed with either the starting blocks 68 or wall blocks 12, the next course of blocks can be laid. The wall blocks are placed on top of the blocks of the starting course with the lock flanges 18 of each block extending into the lock channels 16 of the lower blocks. Once so positioned, the upper blocks are slid forward along the lower blocks until the lock flanges engage the front walls 36 of the lock channels 16 provided in the lower blocks. As can be appreciated from FIG. 8 and with reference to FIGS. 4 and 5, the front surfaces 48 of the lock flanges mate with the frontal lips 42 of the lock channels such that each lock flange 18 extends underneath the frontal lips. This mating relationship holds the wall block in place atop the lower block and prevents it from tipping forward, thereby providing integral locking means for the block.

Once the first wall course has been formed atop the starting course, backfill soil S can be poured into place behind the blocks. Typically, a non-woven filter fabric 70 is provided between the wall and the backfill soil to prevent the introduction of particulate matter between the courses of blocks due to water migration within the soil. Alternatively, a layer of gravel aggregate can be provided between the wall and the soil to serve the same function.

Figure 9:
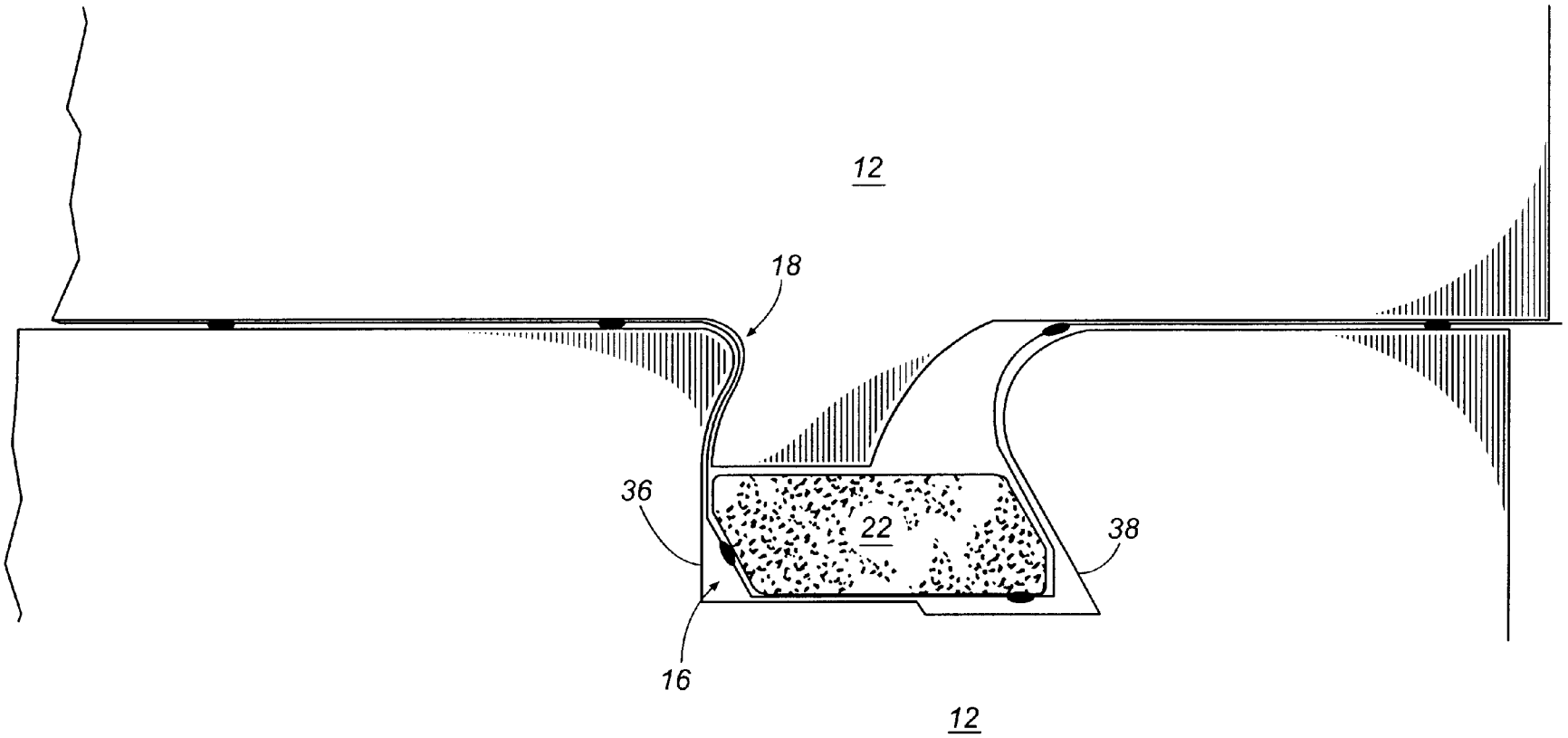
FIG. 9 is a detail view showing the retention of a reinforcement member between adjacent stacked wall blocks.

Additional ascending courses are thereafter laid in the manner described above. Although alternative configurations are possible, a reinforcement member is typically laid between every other course of blocks as indicated in FIG. 8. It will be appreciated, however, that more or fewer reinforcement members can be provided depending upon the particular reinforcement needs of the construction site. Preferably, these reinforcement members 20 are composed of a flexible polymeric fabric. As described above, the reinforcement member is positioned so that it will extend from the exterior surface 15 of the retaining wall, into the lock channel 16, and past the exterior surface 17 of the retaining wall to extend into the soil. As shown most clearly in FIG. 9, a reinforcement member retaining bar 22 is placed on top of the reinforcement member 20 in the lock channel 16. When the next course of blocks 12 is laid on top of the lower course, the lock flange 18 of the upper blocks will extend into the lock channel 16 and will be positioned adjacent the retaining bar.

Construction of the retaining wall 65 continues until the desired height is attained. As indicated in FIG. 8, the inward slope of the wall blocks creates a net inward slope of the retaining wall. Additionally, the configuration the blocks creates an aesthetically pleasing stepped appearance for the exterior surface of the wall. Where the full height of a wall block 12 is unnecessary or not desired, short wall blocks 74 can be used to form the top course. Typically, these short wall blocks are approximately 7.5 inches in height, one half the height of the standard wall blocks 12. Once the retaining wall has been raised to the required height, cap blocks 72 can be used to complete the wall. As shown in FIG. 8, these cap blocks 74 are provided with a lock flange, but do not have an upper lock channel in that further construction will not be conducted. Normally, the cap blocks are fixed in position with concrete adhesive and the top surface of the cap blocks are provided with an ornamental pattern similar to the exterior faces of the blocks. The cap block is designed to extend out over the lower block to provide a lip for aesthetics. Additionally, a subsurface collector drain 76 can be provided within the backfill soil to remove excess water collected therein.

While preferred embodiments of the invention have been disclosed in detail in the foregoing description and drawings, it will be understood by those skilled in the art that variations and modifications thereof can be made without departing from the spirit and scope of the invention as set forth in the following claims. For instance, as briefly referenced above, the sides of the blocks can be tapered inwardly to form a curved wall. As will be appreciated by those having skill in the art, when such a curved wall is constructed, the reinforcement member retaining bar will likewise need to be curved or angled if the builder wishes to extend reinforcement members from the blocks of the curved portions of the wall.

What is claimed is:

1. A modular retaining wall system, comprising:

a wall block including:

an interior block face for forming an interior surface of a segmental retaining wall;

an exterior block face for forming an exterior surface of a segmental retaining wall;

first and second block sides that extend from the exterior block face to the interior block face;

a block top surface having a lock channel formed therein, the lock channel being defined by a channel front wall, a channel rear wall, and an arcuate channel bottom surface, the lock channel extending transversely across the block top surface from the first block side to the second block side, wherein the channel front wall forms a first shoulder that extends towards the interior block face so as to overhang a portion of the channel front wall, wherein the channel rear wall forms a second shoulder that extends towards the exterior block face so as to overhang a portion of the channel rear wall, and wherein the shoulders run generally parallel to each other along the lock channel; and a block bottom surface.

2. The system of claim 1, further comprising:

a soil reinforcement member laid across the block top surface with a portion of the soil reinforcement member laying in front of the lock channel, a portion of the soil reinforcement member laying behind the lock channel, and a portion of the soil reinforcement member inserted in the lock channel; and a retainer bar having front, back, top, and bottom faces, the retainer bar having a front to back dimension that is greater than the closest distance between the first and second shoulders of the lock channel, the retainer bar having a top to bottom dimension that is less than the closest distance between the first and second shoulders of the lock channel;

the lock channel being of such size and shape as to permit the retainer bar to be inserted into the channel through the first and second shoulders, with a portion of the soil reinforcement member interposed between the retainer bar and the channel walls, and then to be rotated into a position below the first and second shoulders in which the retainer bar cannot be removed from the channel, whereby the soil reinforcement member is clamped between the retainer bar and the channel rear wall when a tensile force is exerted on the portion of the soil reinforcement member extending behind the lock channel.

3. The system of claim 1, wherein the wall block further comprises a lock flange on the bottom surface of the block, the lock flange being defined by a flange front surface extending from the block bottom surface, a flange rear surface extending from the block bottom surface, and a flange bottom surface extending between the flange front and rear surfaces, the lock flange extending transversely across the block bottom surface in substantially the same direction as the lock channel, the lock flange being sized, shaped, and positioned so that the flange will fit into the lock channel of a similarly configured wall block in the adjacent lower course when a wall is constructed, wherein the flange front surface includes a portion that extends toward the exterior block face so as to overhang a portion of the flange front surface and is sized and shaped so as to engage the first shoulder of the lock channel of the similarly configured block either directly or indirectly if a portion of a soil reinforcement member is interposed between the flange front surface and the first shoulder, such that when the wall block is stacked atop the similarly configured block, the wall block is properly aligned thereon and the engagement between the lock flange and the lock channel of the similarly configured block resists forward leaning or toppling of the wall block.

4. A segmental retaining wall system for constructing a segmental retaining wall of multiple courses of wall blocks, comprising:

a wall block formed of concrete and including:

an interior block face for forming an interior surface of the segmental retaining wall;

an exterior block face for forming an exterior surface of the segmental retaining wall;

first and second block sides that extend from said exterior block face to said interior block face;

a block top surface having a lock channel formed therein, said lock channel being defined by a channel front wall, a channel rear wall, and an arcuate channel bottom surface, the lock channel extending transversely across the block top surface from the first block side to the second block side, wherein the channel front wall includes a substantially planar surface that is approximately perpendicular to the block top surface, and a frontal lip that extends obliquely forwardly from the substantially planar surface, so as to form a first shoulder that extends towards said interior block face so as to overhang a portion of the channel front wall, wherein the channel rear wall forms a second shoulder that extends toward said exterior block face so as to overhang a portion of the channel rear wall, wherein the first and second shoulders run generally parallel to each other and the closest distance between them defines the throat of the lock channel and wherein the second shoulder is rounded so as to form a substantially arcuate rear edge of the lock channel; and a block bottom surface having a lock flange, said lock flange being defined by a flange front surface extending from the block bottom surface, a flange rear surface extending from the block bottom surface, and a flange bottom surface extending between the flange front and rear surfaces, the lock flange extending transversely across said block bottom surface in substantially the same direction as said lock channel, the lock flange being sized, shaped and positioned so that the flange bottom surface will fit through the channel throat of a similarly configured block in the adjacent lower course when a wall is constructed, wherein the flange front surface includes a portion that extends towards said exterior block face so as to overhang a portion of the flange front surface and is sized and shaped so as to engage the first shoulder of the lock channel of the similarly configured block, either directly, or indirectly if a layer of soil reinforcement material is interposed between the flange front surface and the first shoulder, such that when the wall block is stacked atop the similarly configured block, the wall block is properly aligned thereon and the engagement between the lock flange and the lock channel of the similarly configured block resists forward leaning or toppling of said wall block.

5. The system of claim 4, further comprising:

a soil reinforcement member laid across the block top surface with a portion of the soil reinforcement member laying in front of the lock channel, a portion of the soil reinforcement member laying behind the lock channel, and a portion of the soil reinforcement member inserted in the lock channel; and a retainer bar having front, back, top and bottom faces, the retainer bar having a front to back dimension that is greater than the closest distance between the first and second shoulders of the lock channel, the retainer bar having a top to bottom dimension that is less than the closest distance between the first and second shoulders of the channel;

the lock channel being of such size and shape as to: (1) permit the retainer bar in a first orientation to be inserted into the channel through the throat of the channel, with a portion of the soil reinforcement member interposed between the retainer bar and the channel walls, and then to be rotated into a second orientation below the first and second shoulders in which orientation the retainer bar cannot be removed through the throat of the channel, whereby the soil reinforcement member is clamped between the retainer bar and the channel rear wall when a tensile force is exerted on the portion of the soil reinforcement member extending behind the lock channel; and (2) accommodate the lock flange of a similarly configured wall block in the adjacent upper course when a portion of a soil reinforcement member and a retainer bar in the second orientation are also located in the lock channel.

6. The system of claim 5, wherein the wall block further comprises an interior opening that extends from the first block side to the second block side, whereby, when a plurality of similarly configured blocks are laid side-by-side in a course, the interior openings align to form an internal channel running along the course.

7. The system of claim 6, wherein the soil reinforcement member is a synthetic geogrid material.

* * * * *